United States Patent [19]

Kemper

[11] 4,039,737

[45] Aug. 2, 1977

[54] ELECTRIC IMMERSION HEATING APPARATUS AND METHODS OF CONSTRUCTING AND UTILIZING SAME

[76] Inventor: Eugene L. Kemper, 38520 Delta Drive, Mount Clemens, Mich. 48043

[21] Appl. No.: 658,139

[22] Filed: Feb. 13, 1976

[51] Int. Cl.[2] ..... H05B 7/08

[52] U.S. Cl. ..... 13/18; 219/316

[58] Field of Search ..... 13/18, 20, 25, 23, 6; 219/316

[56] References Cited

U.S. PATENT DOCUMENTS 2,467,837 4/1949 Linden ..... 219/316

*Primary Examiner*—R. N. Envall, Jr.

*Attorney, Agent, or Firm*—Irving M. Weiner; Pamela S. Austin

[57] ABSTRACT

An electric immersion heating apparatus is provided which includes a first tubular electrode which holds a semiconductor substance such as glass or borate lithium oxide therein. Immersed in the semiconductor is at least one other second electrode whose polarity differs from the polarity of the first electrode. The electric current passing through the electrodes heats up the semiconductor material whose heat is thermally transferred through the first electrode into a material, such as aluminum, to be melted. The first electrode may constitute a graphitic ungrounded casing. The heated semiconductor or liquid resistor maintains a uniform temperature, and uniformly transmits heat. The apparatus makes practical 100–200 kilowatts per square foot of surface area times 3–4 feet of immersion depth.

13 Claims, 8 Drawing Figures

FIG. 6
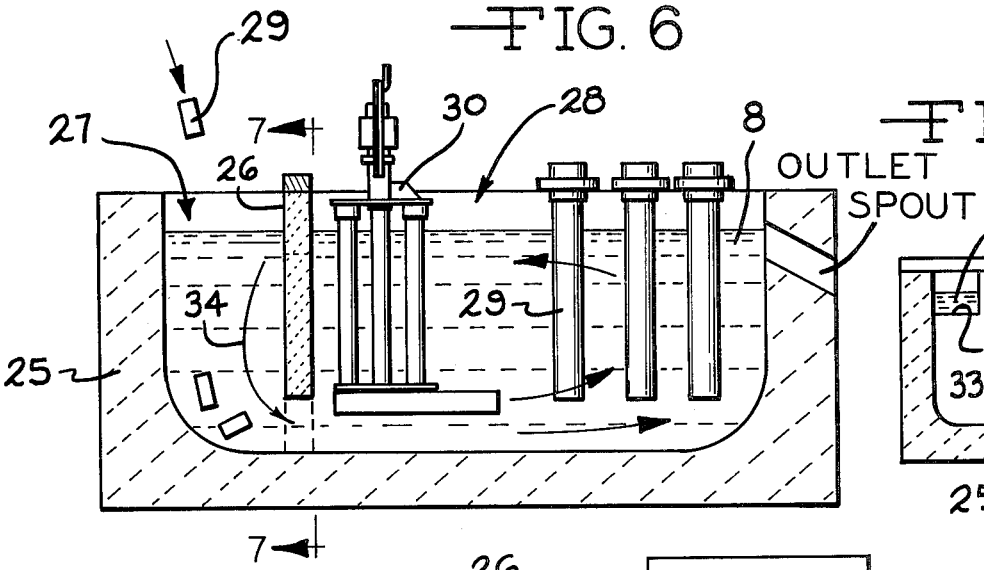
FIG. 7
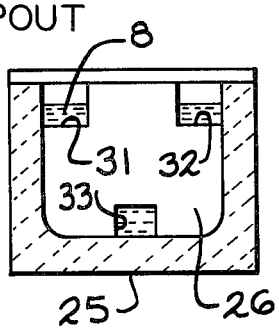
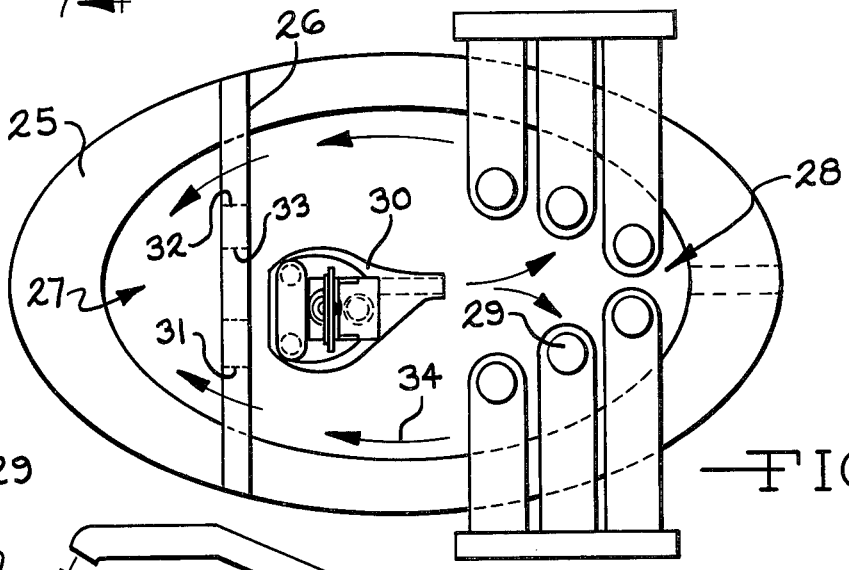
FIG. 5
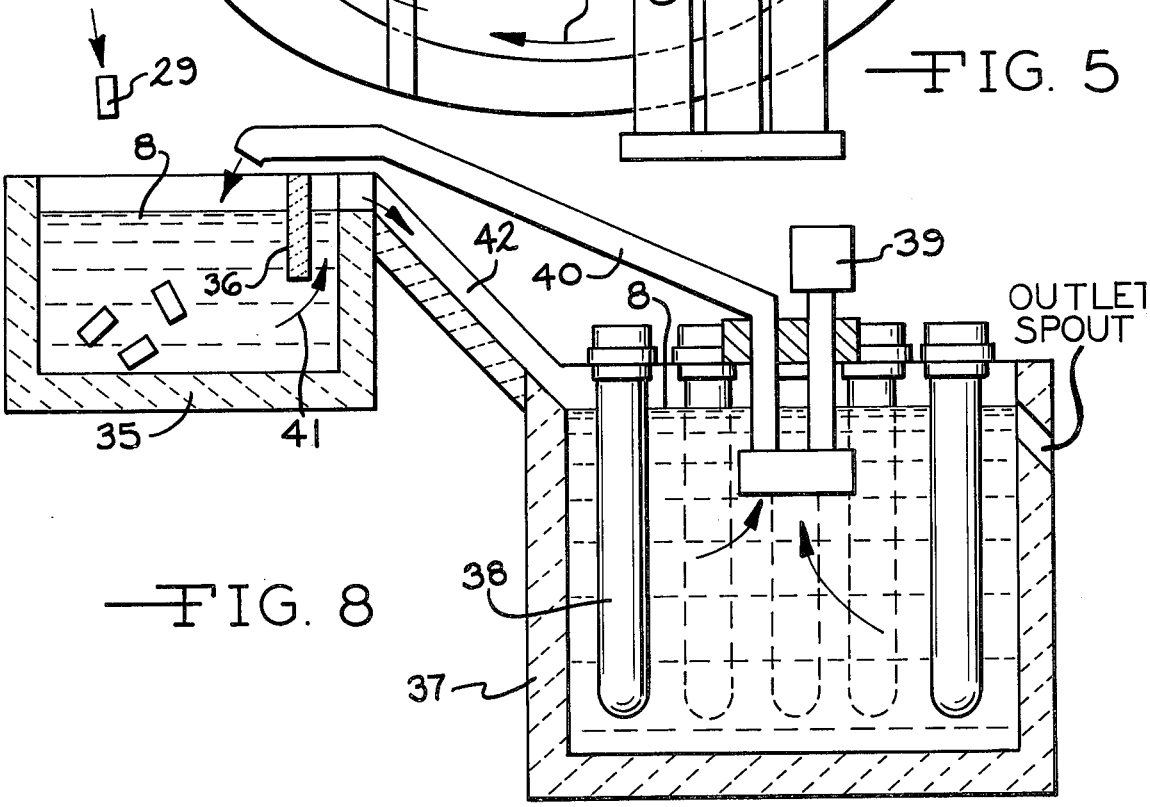
FIG. 8

ELECTRIC IMMERSION HEATING APPARATUS AND METHODS OF CONSTRUCTING AND UTILIZING SAME

The present invention relates generally to an electric immersion heating apparatus, and to novel methods of fabricating and utilizing same. In particular, the present invention relates to an electric immersion heating apparatus wherein the immersion heating element is inert to the liquids and/or solids it is heating.

BACKGROUND OF THE INVENTION

Heretofore, most metals and other substances have been held in the molten state or melted through the use of fossil fuels. These fossil fuels and their resultant extracted energy are introduced into the material to be made or held molten either through immersion tube heating or through radiation by reverberation from refractory chambers.

Due to the recent energy crisis, industry has vociferously expressed a dire need for heating or holding materials in a molten condition through the use of electrical energy. In general, electric heating of liquids or molten metals is not in and of itself new. Heretofore, furnaces have been designed which electrically heat liquids or molten metals by radiation from above the surface of these liquids, or by sheathed immersion elements within these liquids. One of the primary limiting factors to such previous electric heating of these liquids have been the limiting energy input, either through the surface by electric radiation, or within the liquid by immersion heaters. For example, zinc adversely attacks or dissolves immersion tubes which are heated either with fossil fuels or electric resistance heating elements if they are constructed of ferrous alloys. On the other hand, ceramic immersion tubes are too fragile and are generally limited to inputs of 15–50 kilowatts per immersion tube of approximately 10–12 inches in diameter by three feet or more in length of immersion.

Various industries have expressed an urgent need for electric immersion heating element systems which will offer reasonable service life and yet be capable of introducing energies in the order of 100 kilowatts to 200 kilowatts per square foot of immersion tube area.

The present invention fulfills the urgent need expressed by industry, and also avoids the limitations and drawbacks of the prior art equipment and techniques.

SUMMARY OF THE INVENTION

The present invention provides an electric immersion heating apparatus comprising first means for holding at least temporarily therein a first predetermined material. The apparatus also includes second means operatively associated with the first means and disposed at least partially within at least a portion of said first predetermined material. The apparatus further includes third means electrically connected to the first and second means for selectively applying a predetermined difference of electrical potential between the first and second means to control the thermal condition of the first predetermined material. The apparatus further includes fourth means for holding at least temporarily therein a second predetermined material whose thermal condition is to be controlled. The first means is disposed at least partially within at least a portion of the second predetermined material for controlling the thermal condition of the second predetermined material by the use of non-gaseous heat transfer media. The second means is substantially inert to the first predetermined material. The first means is substantially inert to the first predetermined material and is also substantially inert to the second predetermined material.

The present invention also provides a novel method of utilizing the above-described electric immersion heating apparatus, comprising the steps of supplying electrical energy between the first and second means to cause a predetermined electric current to flow therebetween and thereby heat the first predetermined material. The method also includes the step of disposing the first and second means in proximity to the second predetermined material whose thermal condition is to be controlled. The method further includes the step of transferring heat from the first predetermined material, through the first means and from there into the second predetermined material whose thermal condition is to be controlled.

It is an object of the present invention to provide an electric immersion heating apparatus which will offer reasonable service life, and be capable of introducing energies in the order of 100 to 200 kilowatts per square foot of immersion tube area.

Further objects and advantages of the present invention will become apparent from the following description of some particular embodiments thereof which refer to the accompanying drawings.

BRIEF DESCRIPTION OF THE DRAWINGS

FIG. 5 depicts a top plan view of a fourth embodiment of the present invention wherein the charge well is separated from the heating well by a weir.

FIG. 6 shows a central elevational section of the FIG. 5 apparatus.

FIG. 7 illustrates a sectional view taken along the plane 7—7 of FIG. 6.

FIG. 8 shows a fifth embodiment of the present invention wherein the charge well and the heating well are constructed in separate and distinct structures.

DETAILED DESCRIPTION OF PREFERRED EMBODIMENTS

Figure 1:
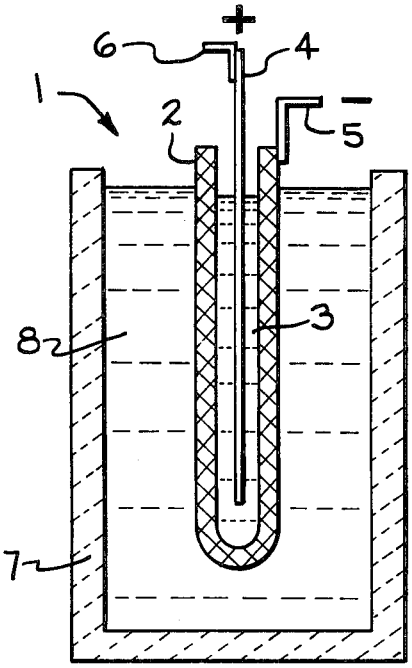
FIG. 1 illustrates a first embodiment of an electric immersion heating apparatus according to the present invention.

With reference to FIG. 1, there is shown an electric immersion heating apparatus 1 which includes first means, such as an electrode 2, for holding at least temporarily therein a first predetermined material 3. The material 3 may be composed of or include, but is not limited to, materials such as semiconductors, glass, salts, borate lithium oxide, glass-type or vitrious compounds, frits supplied by Ferro Corporation of Cleveland, Ohio such as aluminum enamel frit, lead-bearing frit, leadless frit, KA1075A/200 mesh lead-bearing frit, No. 3227/200 mesh leadless frit, and No. 3419/200 mesh lead-bearing frit, and other suitable semiconductor materials which provide the appropriate ohmic resistance.

The apparatus 1 also includes second means, such as electrode 4, operatively associated with the electrode 2 and disposed at least partially within at least a portion of the material 3. The apparatus 1 also includes third means (shown only partially in FIG. 1), such as electrical input conductors 5 and 6, electrically connected to the electrodes 2 and 4, respectively, for selectively applying a predetermined difference of electrical potential between the electrodes 2 and 4 to control the thermal condition of the material 3.

The apparatus 1 also includes fourth means, such as a refractory outer furnace structure 7, for holding at least temporarily therein a second predetermined material 8, such as aluminum, whose thermal condition is to be controlled.

The electrode 2 is disposed at least partially within at least a portion of the material 8 for controlling the thermal condition of the material by the use of non-gaseous heat transfer media. The electrode 4 is substantially inert to the material 3. The electrode 2 is substantially inert to the material 3 and is also substantially inert to the material 8.

Although the first means has been referred to hereinabove as an electrode, such first means need not necessarily constitute an electrode as will be explained hereinbelow with reference to alternate embodiments of the present invention. It is more in keeping with the intent and objects of the present invention to view the first means as a heat exchanger. This becomes more evident when it is understood that the material 3 constitutes a heat exchanger liquid upon being heated by the electric current imposed to the flow therethrough, and the heat from such heat exchanger liquid 3 passes through the first means or heat exchanger 2 to the material 8 which is to be melted or held in a molten state. Such material 8 may constitute a myriad of different substances including, but not limited to, nonferrous metals, ferrous metals, and in general any thermoplastic material. The heat exchanging properties and characteristics of the first means 2 can be augmented and improved as will become evident from the description of the alternate embodiments set forth hereinbelow.

Figure 4:
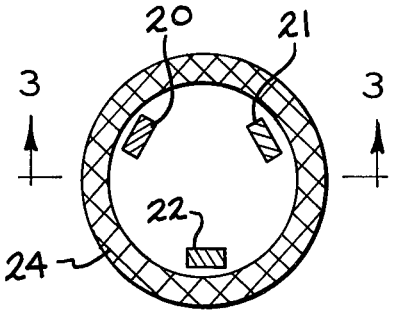
FIG. 4 shows a sectional view of the FIG. 3 embodiment taken along the plane 4—4 of FIG. 3.

Although the third means has been referred to hereinabove as being electrically connected to the first and second means for selectively applying a predetermined difference of electrical potential between the first and second means to control the thermal condition of the first predetermined material, and this does indeed hold true for the embodiments illustrated in FIGS. 1 and 2. The present invention also contemplates third means (as depicted in FIGS. 3 and 4) electrically connected to the second means for selectively causing a predetermined electrical current to flow through at least a portion of the material 3 to control the thermal condition of the material 3.

Figure 2:
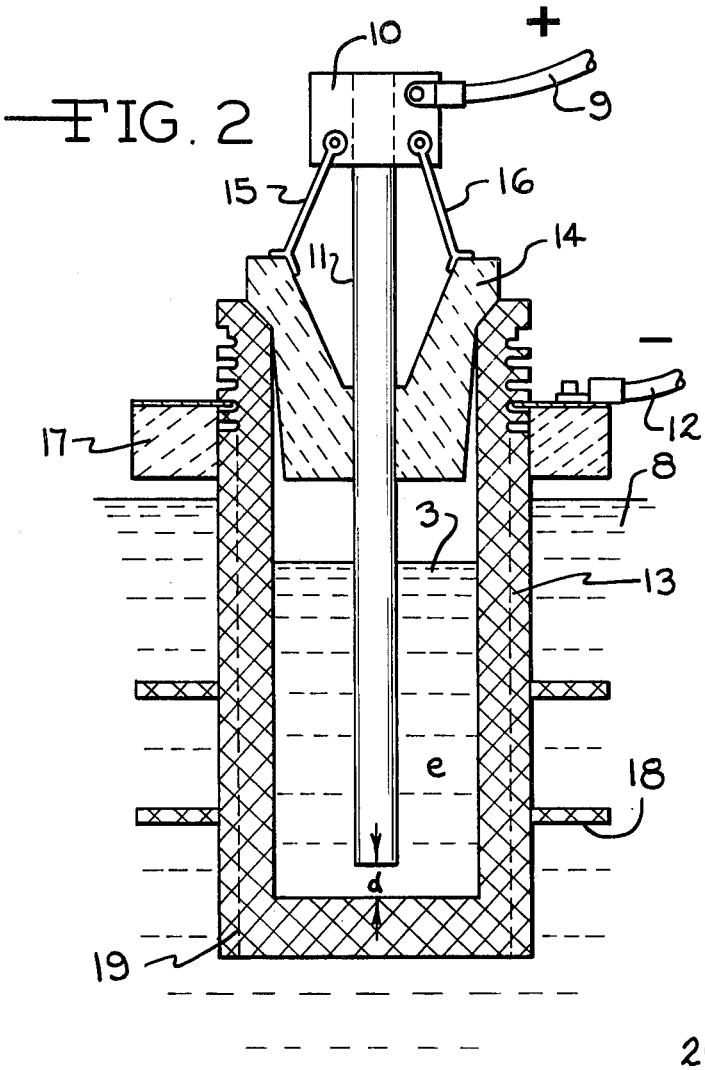
FIG. 2 depicts a second embodiment of an electric immersion heating apparatus according to the present invention.
Figure 3:
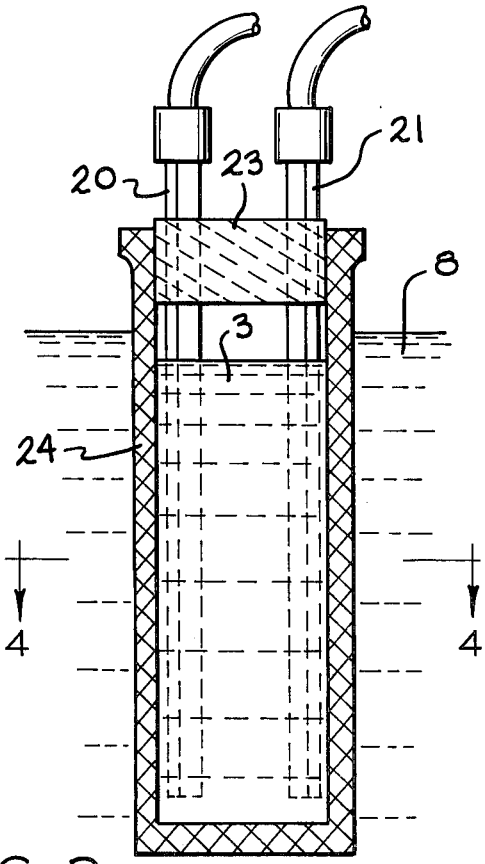
FIG. 3 shows a third embodiment of the electric immersion heating apparatus according to the present invention.

FIG. 2 shows a second embodiment of the invention which includes a positive electric input cable 9 secured to a connector plate or block 10 which supplies a positive potential to an immersion electrode 11. A negative electric input cable 12 is electrically connected to an ungrounded electrode casing heat exchanger 13. The immersion electrode 11 is immersed in the material 3 retained in the heat exchanger 13.

To minimize unnecessary loss of heat from the material 3 to the ambient above the surface of the material or heat exchanger liquid 3, there is provided a plug 14 which should be a non-conductor, such as a bulk fiber plug. Struts 15 and 16 support the block 10 above the plug 14.

The negative electric input cable 12 may be mechanically secured to a pyroblock 17 which is disposed above the surface of the material 8.

To increase the heat transfer efficiency of the heat exchanger 13, there is provided fins 18 which increase the surface area of the heat exchanger in contact with the material 8.

With reference to FIG. 2, the dimensions for an operating working embodiment of the invention included a two inch thick heat exchanger 13 made of graphite, a material 3 consisting of borate lithium oxide or molten glass, a two inch diameter immersion electrode 11, an inner diameter of approximately ten inches for the heat exchanger 13, and a dimension of approximately 30 inches from the top of the heat exchanger 13 to the bottom thereof. The distance $d$ is a function of the distance $e$ between the electrode 11 and the heat exchanger 13 and also a function of the condition of the material 3. To further increase the area of surface contact between the heat exchanger 13 and the material 8, there is provided a series of one-half inch wide notches 19 on one inch centers around the cylindrical periphery of the heat exchanger 13. In the working embodiment of the FIG. 2 apparatus, the immersion electrode 11 was formed from impregnated graphite.

Referring to the third embodiment of the invention as shown in FIGS. 3 and 4, there is provided three electrodes 20, 21 and 22 which are connected to a low voltage three-phase alternating current source by a suitable Y or delta connection (not shown). The electrodes 20, 21 and 22 may be a graphitic or metal composition, depending upon the nature of the material 3. The electrodes 20, 21 and 22 pass through a ceramic fiber plug 23. In such an arrangement, the electric current passes from one such electrode to the other without the necessity of making the heat exchanger 24 an electrode.

Optionally, it may be desired to spin or spiral the immersed electrodes 20, 21 and 22 to effect electromagnetic stirring.

With reference to FIGS. 5, 6 and 7, there is shown a fourth embodiment of the present invention having a refractory outer structure or chamber 25 which is partitioned by a weir 26 into a charge well 27 and a heater well 28. Metal ingots 29 to be melted are placed into the charge well 27.

The heater well 28 includes a plurality of electric immersion heaters 29 such as, for example, the electric immersion heating units illustrated in FIGS. 1 through 4.

Within the heater well 28 there is disposed a pump 30, such as a Model D-30-CSD pump manufactured by The Carborundum Company of Solon, Ohio. The function of the pump 30 is to set up a convection current of the molten material 8 so that the material 8 made molten by the heaters 29 will flow over the weir 26 through the weir apertures 31 and 32 into the charge well 27 and onto the relatively cold ingots 29 to be melted. The currents or flow set up by the pump 30 also causes the melting material 8 to flow under the weir 26 through the lower weir notch 33 and back into the heater well 28. The arrows 34 indicate the convection or flow produced by the pump 30. In this manner the efficiency of the heat transfer is maximized so that the relatively very hot material 8 in the vicinity of the heaters 29 passes onto and over the relatively cold incoming ingots 29 to pre-heat such ingots and to cause initial melting thereof.

FIG. 8 illustrates a fifth embodiment of the present invention which is somewhat similar to the embodiment shown in FIGS. 5–7, with the primary difference being that the charging chamber and the heating chamber are two separate and distinct structures. FIG. 8 shows a refractory charge well structure 35 into which ingots or blocks 29 of material to be melted are conveyed or placed. The charge well structure 35 is provided with a weir 36.

There is also included a refractory heater well chamber 37 which includes a plurality of heaters 38 which may take the form of any of the electric immersion heaters shown in FIGS. 1 through 4. The heater chamber 37 also includes a pump unit 39 which serves to pump the molten material 8 through a conduit 40 so that the molten material 8 will pass over and onto the incoming or relatively-cold ingots 29 in the charge structure 35. As indicated by the flow arrow 41 the melted material 8 in chamber 35 is constrained to pass under the weir 36 and down a sleuth 42 into the heater chamber 37. It is in the heater chamber 37 that the material 8 is brought to the relatively higher temperature desired.

It should be borne in mind that any of the electrodes mentioned hereinabove in connection with the present invention may be made of any suitable material including graphite, metal, impregnated graphite, silica carbide, refractory metal, graphite which has been impregated with an oxidation retardant process wherein the graphite is impregated with an aluminum phosphate or other type of phosphate coating, etc.

Also, the material 8, may be any non-ferrous metal such as aluminum, zinc, lead, tin, or any ferrous metal, or as indicated above, any thermoplastic material.

The material 3 may be an appropriate salt, glass, glass compound, or other suitable semiconductor.

The heat exchanger may be fabricted from silicon carbide, graphite, graphite coated materials, etc.

The present invention also contemplates having the smallest gap, such as dimension *d* fixed between the end of the immersion electrode 4 or 11 and the other electrode 2 or 13, respectively. However, the invention also contemplates an arrangement where the electrode 4 or 11 may be moved in order to obtain the proper starting current and then placed in a position where quiescent electrical conditions prevail during the immersion heating operation.

While it will be apparent that the preferred embodiments of the invention disclosed hereinabove are well calculated to fulfill the objects above stated, it should be appreciated that the present invention is susceptible to various modifications, variations and changes without departing from the proper scope or fair meaning of the subjoined claims.

I claim:

1. An electric immersion heating apparatus, comprising:

first means for holding at least temporarily therein a first predetermined material;

second means operatively associated with said first means and disposed at least partially within at least a portion of said first predetermined material;

third means electrically connected to said second means for selectively causing a predetermined electrical current to flow through at least a portion of said first predetermined material to control the thermal condition of said first predetermined material;

fourth means for holding at least temporarily therein a second predetermined material whose thermal condition is to be controlled;

said first means being disposed at least partially within at least a portion of said second predetermined material for controlling the thermal condition of said second predetermined material by the use of non-gaseous heat transfer media;

said second means being substantially inert to said first predetermined material; and said first means being substantially inert to said first predetermined material and being substantially inert to said second predetermined material.

2. An apparatus according to claim 1, wherein:

said third means is electrically connected to said first and said second means for selectively applying a predetermined difference of electrical potential between said first and second means to control the thermal condition of said first predetermined material.

3. An apparatus according to claim 1, wherein:

said first predetermined material comprises a semiconductor.

4. An apparatus according to claim 1, wherein:

said second predetermined material comprises a metal.

5. An apparatus according to claim 1, wherein said first means comprises at least one heat exchanger.

6. An apparatus according to claim 1, wherein:

said second means includes at least one immersion electrode.

7. An electric immersion heating apparatus comprising:

first means for holding at least temporarily therein a first predetermined material;

second means operatively associated with said first means and disposed at least partially within at least a portion of said first predetermined material;

third means electrically connected to said second means for selectively causing a predetermined electrical current to flow through at least a portion of said first predetermined material to control the thermal condition of said first predetermined material;

fourth means for holding at least temporarily therein a second predetermined material whose thermal condition is to be controlled;

said first means being disposed at least partially within at least a portion of said second predetermined material for controlling the thermal condition of said second predetermined material;

said second means being substantially inert to said first predetermined material;

said first means being substantially inert to said first predetermined material and being substantially inert to said second predetermined material;

a refractory charge well structure in which said second predetermined material to be melted is initially placed;

a passageway communicating and interconnected between said fourth means and said refractory charge well structure by which the melted second predetermined material can pass from said charge well structure into said fourth means under the influence of gravity;

a conduit interconnected between and communicating between said fourth means and said charge well structure;

at least one pump operably connected with and disposed within said fourth means for conveying molten second predetermined material through said conduit and into said charge well structure;

and said fourth means including a plurality of said first, second and third means.

8. An electric immersion heating apparatus comprising:

first means for holding at least temporarily therein a first predetermined material;

second means operatively associated with said first means and disposed at least partially within at least a portion of said first predetermined material;

third means electrically connected to said second means for selectively causing a predetermined electrical current to flow through at least a portion of said first predetermined material to control the thermal condition of said first predetermined material;

fourth means for holding at least temporarily therein a second predetermined material whose thermal condition is to be controlled;

said first means being disposed at least partially within at least a portion of said second predetermined material for controlling the thermal condition of said second predetermined material;

said second means being substantially inert to said first predetermined material;

said first means being substantially inert to said first predetermined material and being substantially inert to said second predetermined material;

a weir operably connected to and disposed within said fourth means for partitioning said fourth means into a charge well area and a heater area;

said heater area including at least one pump unit and a plurality of said first, second and third means;

said weir including a plurality of openings therein through which said second predetermined material may pass;

said charge well serving to receive relatively-cold second predetermined material to be melted; and said pump unit causing said second predetermined material which has been melted by said first, second and third means to pass through certain of the apertures in said weir into said charge well structure, and to pass from said charge well structure into said heater area.

9. A method of utilizing the electric immersion heating apparatus according to claim 1, comprising the steps of:

supplying electrical energy to said second means to cause a predetermined electrical current to flow through at least a portion of said first predetermined material;

controlling the thermal condition of said first predetermined material as a function of the electric current flowing therethrough and the ohmic resistance thereof; and transferring the heat from said first predetermined material through said first means and into said second predetermined material whose thermal condition is to be controlled.

10. An apparatus according to claim 1, wherein:

said first predetermined material is a material selected from the group consisting of glass or glass compounds.

11. An apparatus according to claim 1, wherein:

said first predetermined material comprises a salt.

12. An apparatus according to claim 1, wherein:

said first predetermined material comprises borate lithium oxide.

13. An apparatus according to claim 1, wherein:

said second predetermined material comprises a thermoplastic material.

* * * * *